US006472825B2

(12) United States Patent
Shigeta et al.

(10) Patent No.: US 6,472,825 B2
(45) Date of Patent: Oct. 29, 2002

(54) METHOD FOR DRIVING A PLASMA DISPLAY PANEL

(75) Inventors: Tetsuya Shigeta, Yamanashi (JP); Tetsuro Nagakubo, Yamanashi (JP); Hirofumi Honda, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/836,234

(22) Filed: Apr. 18, 2001

(65) Prior Publication Data

US 2002/0005823 A1 Jan. 17, 2002

(30) Foreign Application Priority Data

Apr. 25, 2000 (JP) ..... 2000-124236

(51) Int. Cl.[7] ..... G09G 3/10; G09G 3/28

(52) U.S. Cl. ..... 315/169.4; 345/66

(58) Field of Search ..... 315/169.1, 169.3, 315/169.4; 345/41, 42, 48, 55, 66, 690

(56) References Cited

U.S. PATENT DOCUMENTS 6,034,482 A * 3/2000 Kanazawa et al. ..... 315/169.1
6,091,398 A * 7/2000 Shigeta ..... 345/204
6,114,348 A * 9/2000 Weber et al. ..... 514/171
6,243,073 B1 * 6/2001 Kawamura et al. ..... 345/213
6,320,560 B1 * 11/2001 Sasaki et al. ..... 315/169.1

* cited by examiner

*Primary Examiner*—Don Wong
*Assistant Examiner*—D A Minh
(74) *Attorney, Agent, or Firm*—Sughrue Mion, PLLC

(57) ABSTRACT

A method for driving a plasma display panel capable of obtaining a good display quality. In a pixel data writing step in a sub-field that is weighted small, discharge cells in the plasma display panel are scanned in a unit of plurality of display lines and are set to one of a light emitting state and a non-light emitting state depending upon the pixel data.

3 Claims, 7 Drawing Sheets

METHOD FOR DRIVING A PLASMA DISPLAY PANEL

BACKGROUND OF THE INVENTION

1. Field of the Invention

This invention relates to a method for driving a plasma display panel.

2. Description of the Related Art

As a thin display device, at present, there has been placed in the market an AC discharge type plasma display panel. The plasma display panel emits light by utilizing the discharge phenomenon and assumes only two states, i.e., a light emitting state corresponding to a maximum brightness level and a non-light emitting state corresponding to a minimum brightness level. In order to obtain a display brightness of a half tone corresponding to a video signal, therefore, a gradation drive is effected for the plasma display panel based upon a sub-field method. In the sub-field method, a display period of a field is divided into N sub-fields to meet the bit digits of pixel data of N bits corresponding to the video signal. A number of times of emitting light (light emitting period) corresponding to the weighting of each bit digit of pixel data is assigned to each of the N sub-fields. The discharge cells are selected to emit light in response to the pixel data bit in each sub-field.

FIG. 1 is a diagram schematically illustrating the construction of a plasma display apparatus for gradation-driving the plasma display panel relying upon the sub-field method.

In FIG. 1, the plasma display panel PDP 10 includes column electrodes $D_1$ to $D_m$ of a number of m, row electrodes $X_1$ to $X_n$ of a number of n and row electrodes $Y_1$ to $Y_n$ of a number of n arranged to intersect the column electrodes. Each pair of row electrodes X and Y produce a display line on the PDP 10. The column electrodes D and the row electrodes X and Y are covered with a dielectric layer for discharge space. A discharge cell that works as a pixel is formed at every portion where a pair of row electrodes intersect a column electrode.

A drive unit 100 gradation-drives the PDP 10 in compliance with a light emission drive format shown in FIG. 2.

In the drive according to the light emission drive format shown in FIG. 2, a display period of a field is divided into six sub-fields SF1 to SF6. A simultaneous resetting step Rc, a pixel data writing step Wc, a light emission-sustaining step Ic and an erasing step E are executed in each sub-field.

FIG. 3 is a timing diagram (in a sub-field) for applying drive pulses to the column electrodes and to the pairs of row electrodes in the PDP 10 by the drive unit 100 to execute the above steps.

In the simultaneous resetting step Rc, first, the drive unit 100 applies a reset pulse $RP_X$ of the negative polarity and a reset pulse $RP_Y$ of the positive polarity to the row electrodes $X_1$ to $X_n$ and $Y_1$ to $Y_n$, simultaneously. In response to the application of these reset pulses $RP_X$ and $RP_Y$, the discharge cells in the PDP 10 all undergo a reset discharge. At this moment, a wall charge of a predetermined quantity is formed uniformly in each discharge cell. Accordingly, every discharge cell is once initially set to be a "light emitting cell".

Next, in the pixel data writing step Wc, the drive unit 100, first, converts the video signal that is received into pixel data of 6 bits for each of the pixels. A first bit of the pixel data is used in the pixel data writing step Wc in a sub-field SF1, a second bit is used in the pixel data writing step Wc in a sub-field SF2, a third bit is used in the pixel data writing step Wc in a sub-field SF3, a fourth bit is used in the pixel data writing step Wc in a sub-field SF4, a fifth bit is used in the pixel data writing step Wc in a sub-field SF5 and a sixth bit is used in the pixel data writing step Wc in a sub-field SF6. The drive unit 100 generates a pixel data pulse corresponding to the logic level of each bit in the pixel data, and applies it to the column electrodes $D_1$ to $D_m$. For example, in the pixel data writing step Wc in the sub-field SF1, the drive unit 100 gives attention to a first bit only of the pixel data, and generates a pixel data pulse of a high voltage when the first bit has a logic level "1" and generates a pixel data pulse of a low voltage (0 bolt) when the first bit has a logic level "0". The drive unit 100 applies pixel data pulse groups $DP_1$, $DP_2$, $DP_3$, . . . , $DP_n$ to the column electrodes $D_1$ to $D_m$ successively as shown in FIG. 3, each of the pixel data pulse groups $DP_1$, $DP_2$, $DP_3$, . . . , $DP_n$ consisting of m pixel data pulses and corresponding to each of the first to n-th display lines in the PDP 10. The drive unit 100 further applies the scanning pulses SP of the negative polarity shown in FIG. 3 successively to the row electrodes $Y_1$ to $Y_n$ at the same timings as the timings of applying the pixel data pulse groups DP. Here, a discharge (selectively erasing discharge) takes place in only the discharge cells at portions where the "rows" to which the scanning pulse SP is applied are intersecting the "columns" to which the pixel data pulse of a high voltage is applied, and the wall charge remaining in the discharge cells is erased. Due to the selectively erasing discharge, the discharge cells initialized to the state of "light emitting cells" in the simultaneously resetting step Rc turn into the "non-light emitting cells". The selectively erasing discharge does not occur in the discharge cells to which the pixel data pulse of a low voltage is applied simultaneously with the application of the scanning pulse SP. Therefore, the discharge cells are maintained in a state of "light emitting cells".

Next, in the light emission-sustaining step Ic, the drive unit 100 alternately applies the sustain pulses $IP_X$ and $IP_Y$ shown in FIG. 3 to the row electrodes $X_1$ to $X_n$ and $Y_1$ to $Y_n$. Here, the number of times (period) of applying the sustain pulses $IP_X$ and $IP_Y$ in each light emission-sustaining step Ic, is set depending upon the weighting of each of the sub-fields. That is, as shown in FIG. 2, the sustain pulses $IP_X$ and $IP_Y$ are repetitively applied numbers of times (periods) for example:

SF1 : 1
SF2 : 2
SF3 : 4
SF4 : 8
SF5 : 16
SF6 : 32

After the pixel data writing step Wc has been finished, only those discharge cells in which the wall charge is remaining undergo the sustain discharge, i.e., only those discharge cells in a state of "light emitting cells" undergo the sustain discharge every time when the sustain pulses $IP_X$ and $IP_Y$ are applied. Therefore, the discharge cells in the state of "light emitting cells", emit light accompanying the discharge the above-mentioned numbers of times (periods). In the discharge cells in the state of "non-light emitting cells", on the other hand, the above-mentioned discharge does not occur even when, for example, a sustain pulse is applied, and the discharge cells stay in the non-light emitting state.

Next, in the erasing step E, the drive unit 100 applies the erasing pulse EP shown in FIG. 3 to the row electrodes $Y_1$ to $Y_n$, whereby the discharge cells all undergo an erase discharge simultaneously to thereby erase the wall charge remaining in the discharge cells.

In the above gradation drive, when a video signal corresponding to, for example, a brightness level "18" (corresponding to pixel data "101101") is fed, light is emitted in the light emission-sustaining step IC in the sub-fields SF2 and SF5 among the sub-fields SF1 to SF6. Therefore, light is emitted a total of 18 times in a field, i.e., 2 times in SF2 and 16 times in SF5, and a half brightness corresponding to the brightness "18" is seen. According to the gradation drive using the above six sub-fields SF1 to SF6, therefore, a half bright display of 64 gradations can be realized in a brightness range of from a brightness level "0" to brightness level "63".

According to the sub-field method, the number of gradations increase with an increase in the number of the sub-fields, and a picture is displayed in a higher quality. Further, the display is obtained in a higher brightness if the number of times of emitting light is increased in the light emission-sustaining step Ic in the sub-fields.

However, since the display period of a field has been specified, limitation is imposed on the number of the sub-fields that are divided and on the number of times of emitting light in the light emission-sustaining step Ic in each sub-field. With the above method, therefore, it is therefore difficult to realize a display quality maintaining a high degree of brightness and a high degree of gradation.

OBJECTS AND SUMMARY OF THE INVENTION

In gradation-driving the plasma display panel relying upon the sub-field method, therefore, it is an object of this invention to provide a driving method capable of realizing a favorable display quality.

According to the invention, there is provide a method for driving a plasma display panel having discharge cells each corresponding to one pixel formed at each of intersecting points between a plurality of row electrodes corresponding to display lines and a plurality of column electrodes intersecting said row electrodes, in response to a video signal, at each of successively appearing sub-fields forming each of the fields of said video signal, which comprises: in each of said sub-fields, executing a pixel data writing step for setting said discharge cell to one of a light emitting state and a non-light emitting state in accordance with pixel data corresponding to the video signal; and a light emission sustaining step for causing only said discharge cell in said light emitting state to emit light by only a number of times assigned in relation to the weighting of each of said sub-fields, wherein in the pixel data writing step in a sub-field of a small weighting, one of said light emitting state and said non-light emitting state is selected every a plurality of said display lines which are simultaneously scanned, in the pixel data writing step in other sub-fields, one of said light emitting state and said non-light emitting state is selected at a display line.

DETAILED DESCRIPTION OF THE PREFERRED EMBODIMENTS

An embodiment of the present invention will be described with reference to the drawings.

Figure 4:
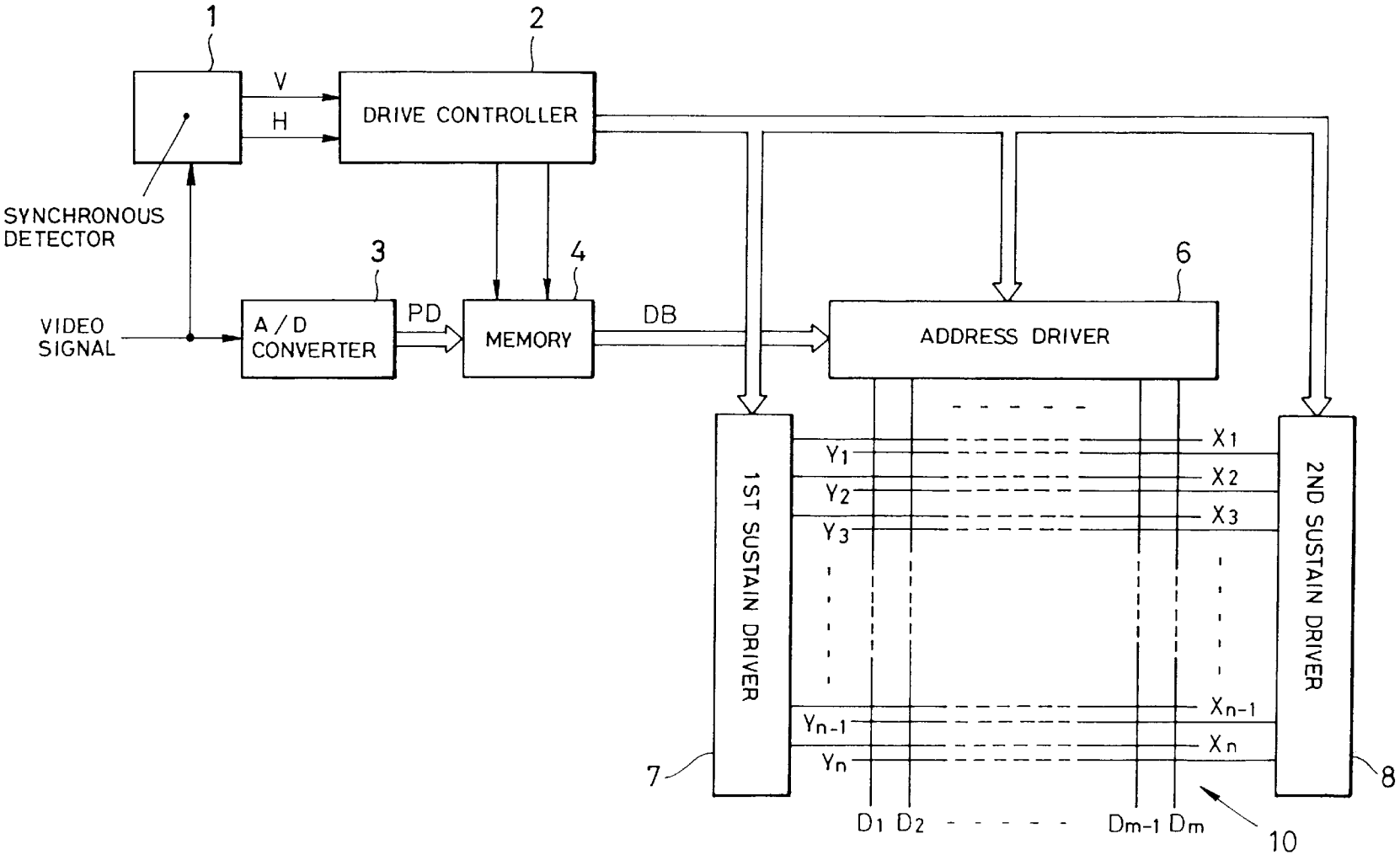
FIG. 4 is a diagram illustrating the construction of a plasma display apparatus for driving the gradation of a plasma display panel based on the driving method of the invention.

FIG. 4 is a diagram schematically illustrating the construction of a plasma display apparatus equipped with a drive unit for gradation-driving a plasma display panel based upon a driving method of this invention.

Referring to FIG. 4, the plasma display apparatus is constructed by a PDP 10 as a plasma display panel and a drive unit comprising modules of various functions that will be described below.

In FIG. 4, the PDP 10 has column electrodes $D_1$ to $D_m$ of a number of m, row electrodes $X_1$ to $X_n$ of a number of n and row electrodes $Y_1$ to $Y_n$ of a number of n arranged to intersect the column electrodes. A pair of row electrodes X and Y produce a line of display on the PDP 10. The column electrodes D and the row electrodes X and Y are covered with a dielectric layer for discharge space, and discharge cells serving as pixels are formed at portions where the pairs of row electrodes intersect the column electrodes.

A drive unit comprises a synchronous detector 1, a drive controller 2, an A/D converter 3, a memory 4, an address driver 6, a first sustain driver 7 and a second sustain driver 8. The drive unit divides a display period of a field into six sub-fields SF1 to SF6 to gradation-drive the PDP 10.

The synchronous detector 1 generates a vertical synchronism detection signal V when a vertical synchronizing signal is detected out of the input video signals, generates a horizontal synchronism detection signal H when a horizontal synchronizing signal is detected, and feeds these signals to the drive controller 2.

The A/D converter 3 samples the input video signals, converts them into pixel data PD of, for example, 4 bits representing the brightness level of every pixel, and feeds them to the memory 4.

The drive controller 2 feeds a write signal for writing pixel data PD to the memory 4. The drive controller 2 further feeds, to the memory 4, read addresses for successively reading pixel data written into the memory 4 from those belonging to the first display line toward those belong to the n-th display line and, further, feeds the read signals to the memory 4.

The memory 4 successively writes the pixel data PD fed from the A/D converter 3 in accordance with the write signals fed from the drive controller 2. The memory 4 executes the following reading operation after a screen of pixel data PD have been written, i.e., after the pixel data PD of a number of (n×m) have been written from pixel data $PD_{11}$ corresponding to a pixel of a first row and a first column through up to a pixel data $PD_{nm}$ corresponding to a pixel of an n-th row and an m-th column.

In the head sub-field SF1, first, the memory 4 traps the first bits of pixel data $PD_{11}$ to $PD_{nm}$ as drive pixel data bits $DB1_{11}$ to $DB1_{nm}$, reads them one display line by one display line according to a read address fed from the drive controller 2, and feeds them to the address driver 6. At this moment, the drive controller 2 successively feeds, to the memory 4, the read addresses corresponding to the first display line and the second display line. Thereafter, the drive controller 2 generates every other read address like fourth display line, sixth display line, and successively feeds them to the memory 4. Accordingly, the memory 4 reads, first, $DB1_{11}$ to $DB1_{1m}$ belonging to the first display line out of the drive pixel data bits $DB1_{11}$ to $DB1_{nm}$ and, then, reads $DB1_{21}$ to $DB1_{2m}$ belonging to the second display line. Thereafter, the memory 4 reads the drive pixel data bits DB1 belonging to a display line of an even number one display line by one display line.

In the next sub-field SF2, the memory 4 traps the second bits of pixel data $PD_{11}$ to $PD_{nm}$ as drive pixel data bits $DB2_{11}$ to $DB2_{nm}$, reads them one display line by one display line according to a read address fed from the drive controller 2, and feeds them to the address driver 6. At this moment, the drive controller 2 successively feeds, to the memory 4, the read addresses corresponding to the first display line and the second display line. Thereafter, the drive controller 2 generates every other read address like fourth display line, sixth display line, and successively feeds them to the memory 4. Accordingly, the memory 4 reads, first, $DB2_{11}$ to $DB2_{1m}$ belonging to the first display line out of the drive pixel data bits $DB2_{11}$ to $DB2_{nm}$ and, then, reads $DB2_{21}$ to $DB2_{2m}$ belonging to the second display line. Thereafter, the memory 4 reads the drive pixel data bits DB2 belonging to a display line of an even number one display line by one display line.

In the next sub-field SF3, the memory 4 traps the third bits of pixel data $PD_{11}$ to $PD_{nm}$ as drive pixel data bits $DB3_{11}$ to $DB3_{nm}$, reads them one display line by one display line according to a read address fed from the drive controller 2, and feeds them to the address driver 6. At this moment, the drive controller 2 successively feeds, to the memory 4, the read addresses corresponding to the first display line through to the n-th display line. Therefore, the memory 4 reads the drive pixel data bits $DB3_{11}$ to $DB3_{nm}$ successively one display line by one display line.

In the next sub-field SF4, the memory 4 traps the fourth bits of pixel data $PD_{11}$ to $PD_{nm}$ as drive pixel data bits $DB4_{11}$ to $DB4_{nm}$, reads them one display line by one display line according to a read address fed from the drive controller 2, and feeds them to the address driver 6. At this moment, the drive controller 2 successively feeds, to the memory 4, the read addresses corresponding to the first display line through to the n-th display line. Therefore, the memory 4 reads the drive pixel data bits $DB4_{11}$ to $DB4_{nm}$ successively one display line by one display line.

In the next sub-field SF5, the memory 4 traps the fifth bits of pixel data $PD_{11}$ to $PD_{nm}$ as drive pixel data bits $DB5_{11}$ to $DB5_{nm}$, reads them one display line by one display line according to a read address fed from the drive controller 2, and feeds them to the address driver 6. At this moment, the drive controller 2 successively feeds, to the memory 4, the read addresses corresponding to the first display line through to the n-th display line. Therefore, the memory 4 reads the drive pixel data bits $DB5_{11}$ to $DB5_{nm}$ successively one display line by one display line.

In the final sub-field SF6, the memory 4 traps the sixth bits of pixel data $PD_{11}$to $PD_{nm}$ as drive pixel data bits $DB6_{11}$ to $DB6_{nm}$, reads them one display line by one display line according to a read address fed from the drive controller 2, and feeds them to the address driver 6. At this moment, the drive controller 2 successively feeds, to the memory 4, the read addresses corresponding to the first display line through to the n-th display line. Therefore, the memory 4 reads the drive pixel data bits $DB6_{11}$ to $DB6_{nm}$ successively one display line by one display line.

Figure 5:
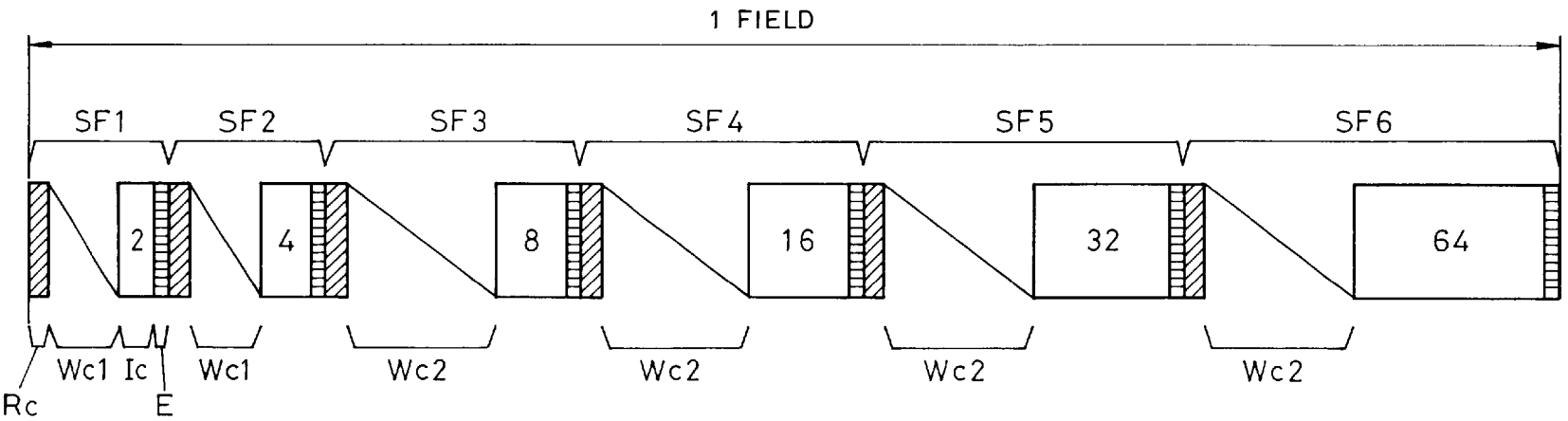
FIG. 5 is a diagram illustrating a light emission drive format based on the driving method of the invention.

The drive controller 2 feeds various timing signals for gradation-driving the PDP 10 to the address driver 6, to the first sustain driver 7 and to the second sustain driver 8 according to the light emission drive format shown in FIG. 5.

In the drive according to the light emission drive format shown in FIG. 5, there are executed the simultaneous resetting step Rc, light emission-sustaining step Ic and erasing step E in each of the above-mentioned six sub-fields SF1 to SF6. Further, a first pixel data writing step Wc1 is executed in the sub-fields SF1 and SF2, and a second pixel data writing step Wc2 is executed in the sub-fields SF3 to SF6.

Figure 6:
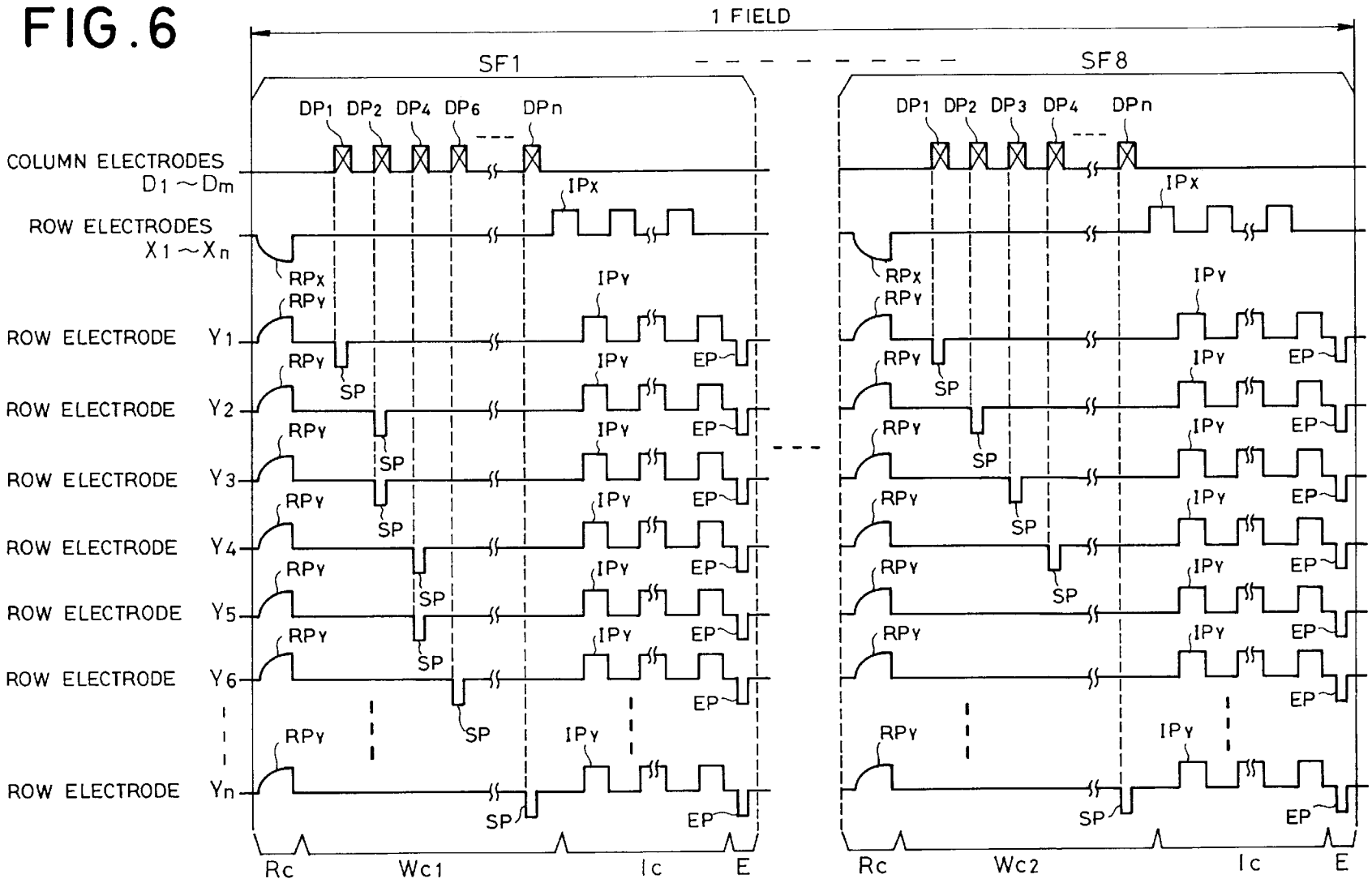
FIG. 6 is a diagram illustrating various drive pulses applied to the PDP 10 in compliance with the light emission drive format shown in FIG. 5 and timings for applying the drive pulses.

FIG. 6 is a diagram illustrating various drive pulses applied to the column electrodes and the pairs of row electrodes of the PDP 10 from the address driver 6, from the first sustain driver 7 and from the second sustain driver 8 according to the light emission drive format shown in FIG. 5, and the timings for applying the drive pulses. The drive pulses applied in the sub-fields SF1 and SF2, and the timings for applying the pulses, are the same. Further, the drive pulses applied in the sub-fields SF3 to SF8, and the timings for applying the pulses, are the same. Therefore, FIG. 6 illustrates the operations in the sub-fields SF1 and SF8 only.

In the simultaneous resetting step Rc in FIG. 6, the first sustain driver 7 generate a reset pulse $RP_X$ of the negative polarity and the second sustain driver 8 generates a reset pulse $RP_Y$ of the positive polarity, which are applied to the row electrodes X and Y of the PDP 10 simultaneously. Therefore, the discharge cells in the PDP 10 are all reset-discharged to forcibly form a wall charge in the discharge cells. Accordingly, the discharge cells in the PDP 10 are all initialized to the state of "light emitting cells".

In the first pixel data writing step Wc1 executed in the sub-fields SF1 and SF2 only, the address driver 6 generates a pixel data pulse having a pulse voltage that varies depending upon the drive pixel data bit DB fed from the memory 4. For example, the address driver 6 generates a pixel data pulse of a high voltage when the drive pixel data bit DB has a logic level "1". The address driver 6 generates a pixel data pulse of a low voltage (0 volt) when the drive pixel data bit DB has a logic level "0". The address driver 6 successively applies, to the column electrodes $D_1$ to $D_m$, the pixel data pulse groups DP for every display line. In this case, as described earlier, the drive pixel data bits DB corresponding to the first display line and the second display line are successively read out from the memory 4 one display line by one display line in the sub-fields SF1 and SF2. Thereafter, the drive pixel data bits DB of every other display line are successively read out from the memory 4 like fourth display line, sixth display line, eighth display line. In the first pixel data writing step Wc1, therefore, the address driver 6 successively applies the pixel data pulse groups $DP_1$, $DP_2$, $DP_4$, $DP_6$, $DP_8$, . . . , $DP_n$ corresponding to the first, second, fourth, sixth, eighth, . . . , n-th display lines to the column electrodes $D_1$ to $D_m$ of the PDP 10 as shown in FIG. 6. In the first pixel data writing step Wc1, further, the second sustain driver 8 generates scanning pulses SP of the negative polarity at the same timings as the timings for applying the pixel data pulse groups $DP_1$, $DP_2$, $DP_4$, $DP_6$, $DP_8$, . . . , $DP_n$. At this moment as shown in FIG. 6, the second sustain driver 8 applies the scanning pulse SP generated at the same timing as the pixel data pulse group $DP_1$ to the row electrode $Y_1$. Next, the second sustain driver 8 applies the scanning pulse SP generated at the same timing as the pixel data pulse group $DP_2$ to the row electrodes $Y_2$ and $Y_3$ simultaneously as shown in FIG. 6. Thereafter, the second sustain driver 8 successively applies the scanning pulses SP generated at the same timings as the pixel data pulse groups $DP_4$, $DP_6$, $DP_8$, . . . , $DP_n$ to the row electrodes $Y_3$ to $Y_n$, i.e., applies the scanning pulses SP simultaneously to the two consecutive row electrodes as shown in FIG. 6.

In the second pixel data writing step Wc2 executed in the sub-fields SF3 to SF6, the drive pixel data bits DB are successively read out from the memory 4 one display line by one display line. The address driver 6 generates a pixel data pulse of a high voltage when the drive pixel data bit DB has a logic level "1". The address driver 6 generates a pixel data pulse of a low voltage (0 volt) when the drive pixel data bit DB has a logic level "0". The address driver 6 successively applies, to the column electrodes $D_1$ to $D_m$, the pixel data pulse groups $DP_1$ to $DP_n$ for every display line. In the second pixel data writing step Wc2, the second sustain driver 8 generates the scanning pulses SP at the same timings as the timings for applying the pixel data pulse groups $DP_1$ to $DP_n$, and successively applies them to the row electrodes $Y_1$ to $Y_n$ as shown in FIG. 6.

In the above first pixel data writing step Wc1 or in the second pixel data writing step Wc2, the electric discharge (selectively erasing discharge) takes place in the discharge cells only at portions where the "row" to which the scanning pulse SP is applied intersects the "column" to which the pixel data pulse of the high voltage is applied. The wall discharge formed in the discharge cells extinguishes due to the selectively erasing discharge, and the discharge cells turn into the state of "non-light emitting cells". The selectively erasing discharge does not occur in the discharge cells to which the pixel data pulse of the low voltage is applied in addition to the above scanning pulse SP, and the state initialized by the above simultaneous resetting step Rc is maintained, i.e., the state of the "light emitting cells" is maintained.

Upon executing the first pixel data writing step Wc1 and the second pixel data writing step Wc2, the pixel data for each pixel corresponding to the input video signal are written into the discharge cells while being scanned in a unit of a display line (this operation is hereinafter referred to as pixel data write scanning).

At this moment in the second pixel data writing step Wc2 as shown in FIG. 6, the pixel data write scanning is effected from the first display line toward the n-th display line one display line by one display line. In the first pixel data writing step Wc1, on the other hand, the pixel data write scanning is effected for the two display lines every time.

In the light emission-sustaining step Ic in the sub-fields, the first sustain driver 7 and the second sustain driver 8 alternately apply sustain pulses $IP_X$ and $IP_Y$ of the positive polarity to the row electrodes $X_1$ to $X_n$ and $Y_1$ to $Y_n$ as shown in FIG. 6. Here, the numbers of times of applying the sustain pulses IP in each light emission-sustaining step Ic in the sub-fields SF1 to SF6 are as follows:

SF1 : 2
SF2 : 4
SF3 : 8
SF4 : 16
SF5 : 32
SF6 : 64

Due to the above operation, the discharge cells in which the wall charge is remaining undergo the sustain discharge, i.e., the discharge cells in the state of "light emitting cells" undergo the sustain discharge every time when the sustain pulses $IP_X$ and $IP_Y$ are applied thereto, and the light emitting state is maintained accompanying the sustain discharge by the above-mentioned number of times (period).

Figure 9:
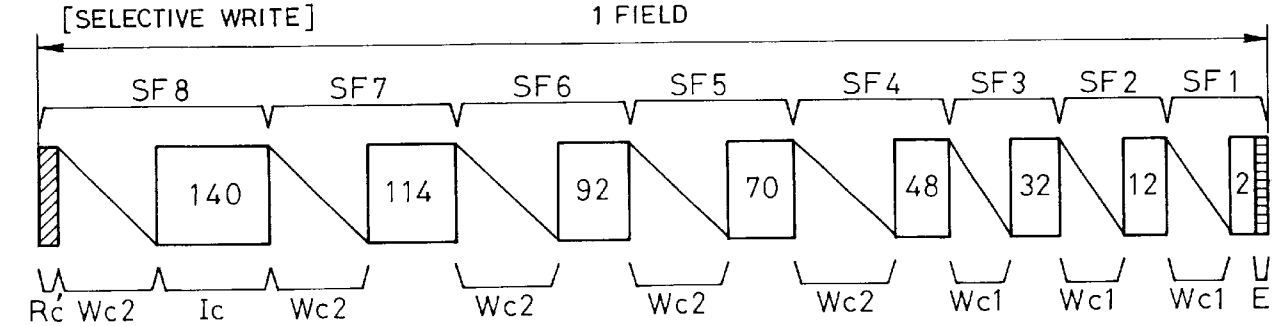
FIG. 9 is a diagram illustrating another light emission drive format (employing a selectively writing address method) based on the driving method of the invention.

In the erasing step E at the end of the sub-fields, the second sustain driver 8 applies the erase pulse EP shown in FIG. 9 to the row electrodes $Y_1$ to $Y_n$, so that the all of the discharge cells undergo the erase discharge simultaneously. Therefore, the wall charge remaining in the discharge cells all extinguishes.

Figure 1:
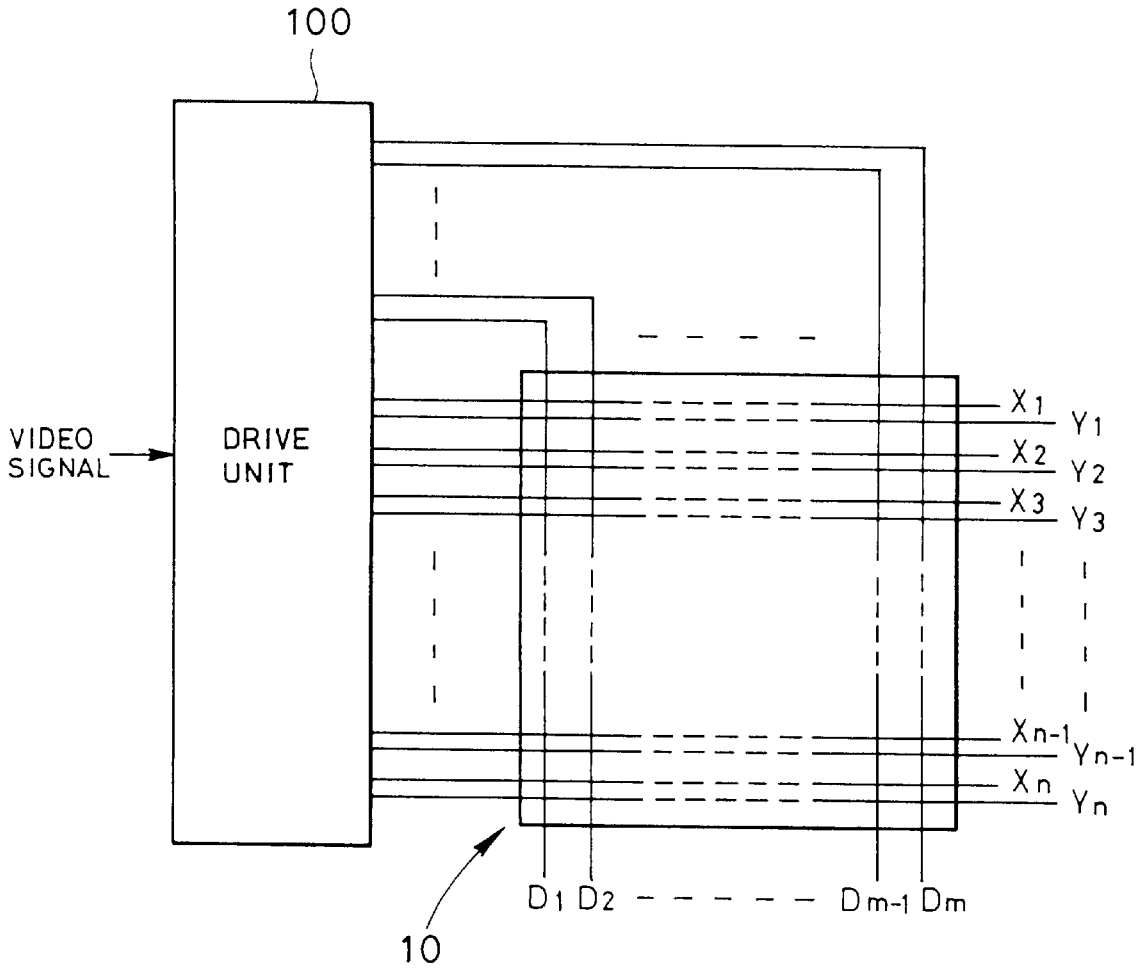
FIG. 1 is a diagram schematically illustrating the construction of a plasma display apparatus.
Figure 2:
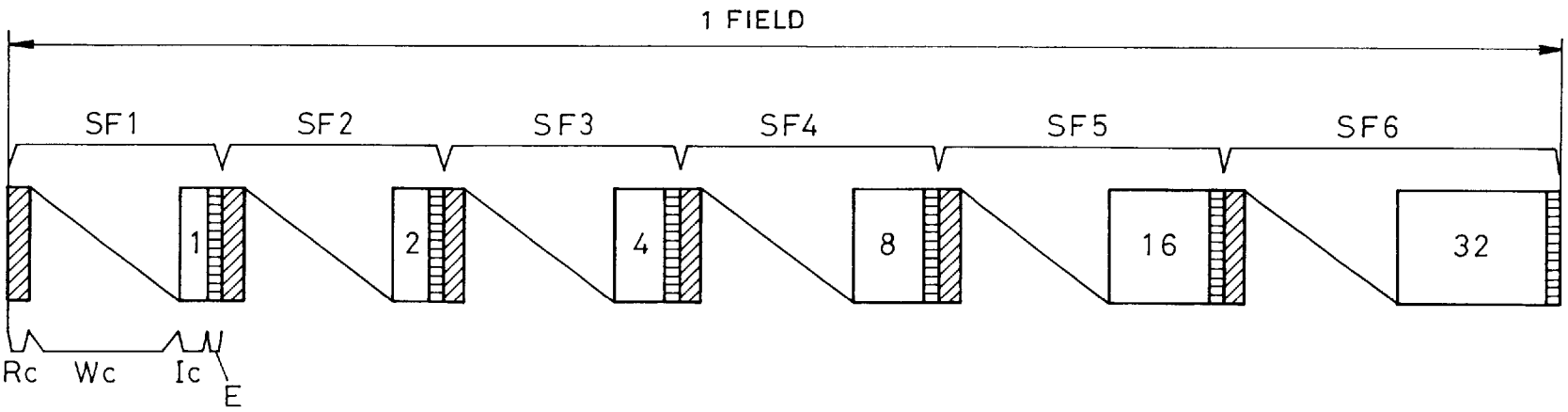
FIG. 2 is a diagram illustrating a conventional light emission drive format based on a sub-field method.
Figure 3:
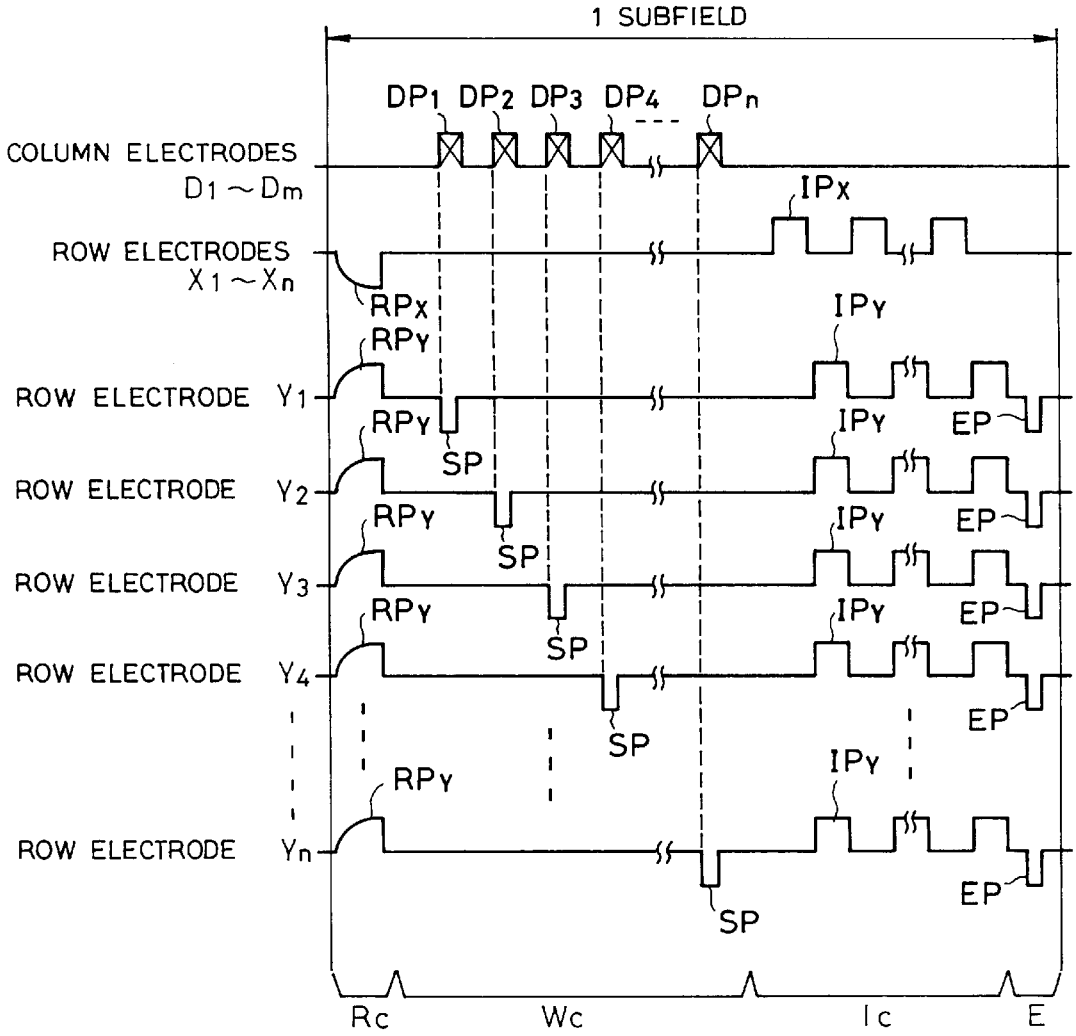
FIG. 3 is a diagram illustrating various drive pulses applied to a PDP 10 in compliance with the light emission drive format shown in FIG. 2 and timings for applying the drive pulses.

Here, if light is emitted in the light emission-sustaining step Ic in all sub-fields SF1 to SF6 relying on the gradation drive shown in FIGS. 5 and 6 as described above, light is emitted a total of 127 times, i.e., 2 times in the SF1, 4 times in the SF2, 8 times in the SF3, 16 times in the SF4, 32 times in the SF5 and 64 times in the SF6. That is, a maximum brightness level "127" is obtained. According to this gradation drive, therefore, a highly bright 64-gradation display is accomplished compared to the gradation drive shown in FIGS. 2 and 3 in which the maximum brightness level is "63".

That is, according to the present invention, the pixel data write scanning is executed for the two display lines every time in the sub-fields SF1 and SF2 where light is emitted relatively small numbers of times in order to shorten the time consumed in the step of writing pixel data. The number of times of emitting light (light emission-sustaining period) is increased in the light emission-sustaining step by the time that is shortened, in order to increase the brightness. Here, the same pixel data are written onto the two display lines resulting in a drop in the resolution. However, the emission of light in the sub-fields, where light is emitted small numbers of times, has a small weight in the gradation display, and a drop in the resolution is not visually perceived.

In the above embodiment, the pixel data write scanning is effected for the two display lines every time in the sub-fields where light is emitted relatively small numbers of times. It is, however, also allowable to effect the pixel data write scanning in a unit of three or more display lines.

It is further allowable to enhance the gradation by increasing the number of sub-fields by an amount of time shortened in the pixel data writing step.

In short, in the present invention, the pixel data are written simultaneously for plural display lines in the sub-fields where light is emitted relatively small numbers of times, i.e., in the sub-fields where the gradation display is less weighted, in order to shorten the time consumed in the pixel data writing step. Instead, the number of times of emitting light (light emission-sustaining period) is increased in the light emission-sustaining step by an amount of time that is shortened, or the number of sub-fields is increased, in order to accomplish a highly bright display or a display of a high gradation.

The above embodiment has dealt with the case of employing a so-called selectively erasing address method in which the discharge cells are selectively discharged (selectively erasing discharge) depending upon the pixel data to extinguish the wall charge. The invention, however, can also be similarly applied to the case of employing a so-called selectively writing address method in which the discharge cells are selectively discharged (selectively writing discharge) depending upon the pixel data in order to form a wall charge in the discharge cells.

In the foregoing was described the operation of the invention that was applied to the gradation drive in which the simultaneous resetting step Rc, the first pixel data writing step Wc1 (or the second pixel data writing step Wc2), the light emission-sustaining step Ic and the erasing step E were executed in each of the sub-fields as shown in FIG. 5. The invention, however, can also be applied to other drives than the drive shown in FIG. 5.

Figure 7:
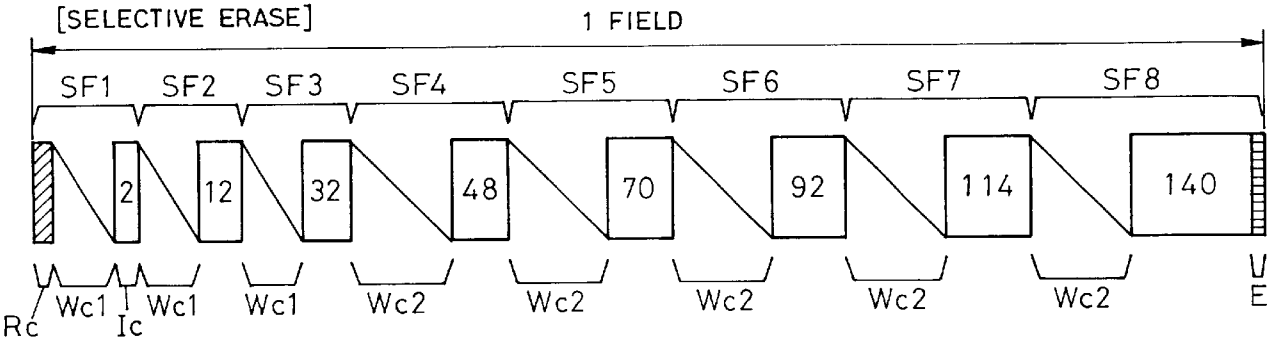
FIG. 7 is a diagram illustrating another light emission drive format (employing a selectively erasing address method) based on the driving method of the invention.

FIG. 7 is a diagram illustrating another light emission drive format based on the driving method of the invention.

In the drive shown in FIG. 7, a display period of a field is divided into eight sub-fields SF1 to SF8, and the gradation drive for the PDP 10 is effected relying upon the selectively erasing address method described above. In each sub-field, the first pixel data writing step Wc1 (or the second pixel data writing step Wc2) and the light emission-sustaining step Ic are executed like the one shown in FIG. 5. Here, the first pixel data writing step Wc1 is executed in the sub-fields SF1 to SF3 where light is emitted small numbers of times, and the second pixel data writing step Wc2 is executed in the remaining sub-fields SF4 to SF8. However, the simultaneous resetting step Rc is executed in the head sub-field SF1 only, and the erasing step E is executed in the final sub-field SF8 only.

In the simultaneous resetting step Rc, the discharge cells in the PDP 10 are all reset-discharged to form a wall charge in the discharge cells. Thus, all of the discharge cells are initialized to the state of "light emitting cells".

In the first pixel data writing step Wc1 executed in the sub-fields SF1 to SF3 only, the pixel data write scanning is executed for the two display lines every time like the operation in the first pixel data writing step Wc1 shown in FIG. 6. In the second pixel data writing step Wc2 executed in the sub-fields SF4 to SF8, on the other hand, the pixel data write scanning is executed for one display line every time like the operation in the second pixel data writing step Wc2 shown in FIG. 6. Due to the above pixel data write scanning, the selectively erasing discharge occurs in only those discharge cells at the portions where the display lines to which the scanning pulse SP is applied intersect the columns to which the pixel data pulse of a high voltage is applied, and the wall charge remaining in the discharge cells is selectively erased. Due to the selectively erasing discharge, the discharge cells that had been initialized to the state of "light emitting cells" in the simultaneous resetting step Rc are turned into the state of "non-light emitting cells". The selectively erasing discharge does not take place in the discharge cells belonging to the "columns" to which the pixel data pulse of the high voltage is not applied. Therefore, these discharge cells are maintained in the state that was initialized through the simultaneously resetting step Rc, i.e., are maintained in the state of "light emitting cells". In practice, however, the selectively erasing discharge takes place only once in the discharge cells throughout the sub-fields SF1 to SF8. That is, the discharge cells are maintained in the state of "light emitting cells" from when the simultaneous resetting step Rc is executed until when the selectively erasing discharge is executed and are, then, held in the state of "non-light emitting cells" until the simultaneous resetting step Rc is executed in the next field. Here, in the pixel data writing step of which one of the sub-fields SF1 to SF8 the selectively erasing discharge should be effected, is determined depending upon the brightness level represented by the pixel data corresponding to the input video signal.

Next, in the light emission-sustaining step Ic shown in FIG. 7, light is repetitively emitted in only those discharge cells in which the wall charge is remaining, i.e., in only those discharge cells in the state of "light emitting cells". Here, the numbers of times of emitting light (light emission times) are set in each of the sub-fields as follows:

SF1 : 2
SF2 : 12
SF3 : 32
SF4 : 48
SF5 : 70
SF6 : 92
SF7 : 114
SF8 : 140

According to the gradation drive shown in FIG. 7, therefore, a half-tone brightness display of 9 gradations is effected over a range of brightness levels of from "0" to "510".

Figure 8:
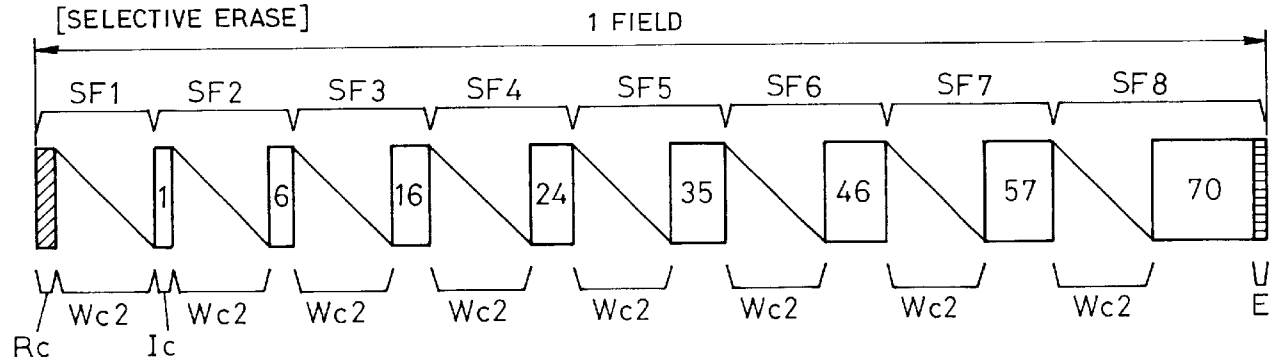
FIG. 8 is a diagram illustrating a conventional light emission drive format.

In the gradation drive shown in FIG. 7 in this case, the pixel data write scanning is executed for the two display lines every time in the sub-fields SF1 to SF3 where light is emitted relatively small numbers of times like the operation in the first pixel data writing step Wc1 shown in FIG. 6. Therefore, the first pixel data writing step Wc1 is executed in a period of time shorter than that required by the second pixel data writing step Wc2 which executes the pixel data write scanning for one display line every time. Instead, the number of times of emitting light (light emission time) is increased in the light emission-sustaining step Ic in each of the sub-fields SF1 to SF8 by an amount of time that is shortened, making it possible to display the picture maintaining a brightness higher than that of when the second pixel data writing step Wc2 is executed in all of the sub-fields as shown in FIG. 8.

The invention may further be modified into the one in which the selectively writing address method is employed for the drive that is shown in FIG. 7.

FIG. 9 is a diagram illustrating a light emission drive format that is realized by employing the selectively writing address method for the drive shown in FIG. 7.

In the drive shown in FIG. 9, the arrangement of sub-fields SF shown in FIG. 7 is reversed. That is, the sub-field SF8 is brought to a head sub-field and the sub-field SF1 is brought to a final sub-field. The simultaneous resetting step Rc' is executed in the head sub-field SF8 only to initialize all discharge cells into the state of "non-light emitting cells", and the erasing step E is executed in the final sub-field SF1 only. The second pixel data writing step Wc2 is executed in the sub-fields SF1 to SF3, and the first pixel data writing step Wc1 is executed in SF4 to SF8, like in the case of FIG. 7. Here, in the pixel data write scanning in the first pixel data writing step Wc1 and in the second pixel data writing step Wc2, the selectively writing discharge takes place in only those discharge cells at portions where the display lines to which a scanning pulse SP is applied intersect the "columns" to which the pixel data pulse of the high voltage is applied, and a wall charge is selectively formed in the discharge cells. Due to the selectively writing discharge, the discharge cells initialized to the state of "non-light emitting cells" through the above simultaneous resetting step Rc' are turned into the state of "light emitting cells". The above selectively writing discharge does not occur in the discharge cells belonging to the "columns" to which the pixel data pulse of the high voltage was not applied. That is, the discharge cells are maintained in the state initialized through the simultaneous resetting step Rc', i.e., are maintained in the state of "non-light emitting cells". In practice, however, the selectively writing discharge occurs only once in the discharge cells throughout the sub-fields SF1 to SF8. That is, the discharge cells are maintained in the state of "non-light emitting cells" from when the simultaneous resetting step Rc' is executed until when the selectively writing discharge is executed and are, then, held in the state of "light emitting cells" until the simultaneous resetting step Rc' is executed in the next field. Here, in the pixel data writing step of which one of the sub-fields SF1 to SF8 the selectively writing discharge should be effected, is determined depending upon the brightness level represented by the pixel data corresponding to the input video signal.

In the gradation drive employing the selectively writing address method shown in FIG. 9 as described above, too, the pixel data write scanning is executed for plural display lines every time in the sub-fields SF1 to SF3 where light is emitted relatively small numbers of times, in order to shorten the time consumed by the pixel data writing. Therefore, the display of a high brightness is realized upon increasing the number of times of emitting light (light emission time) in the light emission-sustaining step Ic in the sub-fields SF1 to SF8 by an amount of time that is shortened, or the display of a high gradation is realized upon increasing the number of sub-fields executed in a field by an amount of time that is shortened.

According to the invention as described above in detail, the pixel data write scanning is effected for a unit of plural display lines in the pixel data writing step in the sub-fields where light is emitted relatively small numbers of times (light emission time is short), i.e., in the sub-fields where the so-called gradation display is less weighted.

According to the invention which shortens the time needed by the pixel data writing step, therefore, the number of times of emitting light (light emission time) can be increased in the light emission-sustaining step or the number of the sub-fields is increased by an amount of time that is shortened, making it possible to accomplish a favorable display maintaining a high degree of brightness or a high degree of gradation.

This application is based on a Japanese application No. 2000-124236 which is hereby incorporated by reference.

What is claimed is:

1. A method for driving a plasma display panel having discharge cells each corresponding to one pixel formed at each of intersecting points between a plurality of row electrodes corresponding to display lines and a plurality of column electrodes intersecting said row electrodes, in response to a video signal, at each of successively appearing sub-fields forming each of the fields of said video signal, which comprises:

in each of said sub-fields, executing a pixel data writing step for setting said discharge cell to one of a light emitting state and a non-light emitting state in accordance with pixel data corresponding to the video signal; and a light emission sustaining step for causing only said discharge cell in said light emitting state to emit light by only a number of times assigned in relation to the weighting of each of said sub-fields, wherein in the pixel data writing step in a sub-field of a small weighting, one of said light emitting state and said non-light emitting state is selected every a plurality of said display lines which are simultaneously scanned, in the pixel data writing step in other sub-fields, one of said light emitting state and said non-light emitting state is selected at a display line.

2. The method for driving a plasma display panel according to claim 1, wherein a resetting step is executed to simultaneously initialize all of said discharge cells to said light emitting state in a head sub-field only in the display period of a field, and said discharge cells in said light emitting state are set to said non-light emitting state in said pixel data writing step only in any one of said sub-fields.

3. The method for driving a plasma display panel according to claim 1, wherein a resetting step is executed to simultaneously initialize all of said discharge cells to said non-light emitting state in a head sub-field only in the display period of a field, and said discharge cells in said non-light emitting state are set to said light emitting state in said pixel data writing step only in any one of said sub-fields.

* * * * *